US009402519B2

(12) United States Patent
Andrikanich et al.

(10) Patent No.: US 9,402,519 B2
(45) Date of Patent: Aug. 2, 2016

(54) ACCESSORY TOOL FOR A VACUUM CLEANER

(71) Applicant: Techtronic Industries Co. Ltd., Tsuen Wan, New Territories (HK)

(72) Inventors: Justin C. Andrikanich, Stow, OH (US); Christopher M. Charlton, Medina, OH (US); Robert Bozzelli, Glenwillow, OH (US); David Chaney, Sagamore Hills, OH (US); Joseph Sternad, Glenwillow, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 0 days.

(21) Appl. No.: 14/607,834

(22) Filed: Jan. 28, 2015

(65) Prior Publication Data

US 2015/0208890 A1 Jul. 30, 2015

Related U.S. Application Data

(60) Provisional application No. 62/050,300, filed on Sep. 15, 2014.

(30) Foreign Application Priority Data

Jan. 29, 2014 (CN) ..... 2014 2 0057281 U

(51) Int. Cl.
*A47L 9/06* (2006.01)

(52) U.S. Cl.
CPC *A47L 9/06* (2013.01); *A47L 9/0693* (2013.01)

(58) Field of Classification Search
CPC ..... A47L 9/06; A47L 9/24; A47L 9/0693
USPC ..... 15/394, 398, 415.1
IPC ..... A47L 9/06
See application file for complete search history.

(56) References Cited

U.S. PATENT DOCUMENTS

| | | | |
|---|---|---|---|
| 2,178,849 | A | 11/1939 | Beuer |
| 3,110,923 | A | 11/1963 | Berleme |
| 5,235,722 | A | 8/1993 | Harris et al. |
| 5,337,445 | A | 8/1994 | Harris et al. |
| 5,359,751 | A | 11/1994 | Bellardini |
| 5,765,259 | A | 6/1998 | Cika |
| 6,345,409 | B1 | 2/2002 | LaCroix |
| 2003/0167592 | A1 | 9/2003 | Egnatovich |
| 2012/0167919 | A1 | 7/2012 | Kunes |

FOREIGN PATENT DOCUMENTS

JP 2012115288 6/2012

OTHER PUBLICATIONS

International Search Report and Written Opinion for Application No. PCT/US2015/013321 dated Apr. 20, 2015 (11 pages).

*Primary Examiner* — David Redding

(74) *Attorney, Agent, or Firm* — Michael Best & Friedrich LLP

(57) ABSTRACT

An accessory tool for a vacuum cleaner. The accessory tool includes a main body including a suction conduit configured to be coupled to the vacuum cleaner, a suction opening in fluid communication with the suction conduit, a longitudinal first brush made from a first material positioned adjacent the suction opening, and a second brush spaced from the first brush forming a brush opening between the first and second brushes configured to receive an object being cleaned. The second brush is made from a second material different than the first material and generally positioned over the first brush.

16 Claims, 5 Drawing Sheets

ACCESSORY TOOL FOR A VACUUM CLEANER

CROSS-REFERENCE TO RELATED APPLICATIONS

This application claims priority to U.S. Provisional Patent Application No. 62/050,300, filed Sep. 15, 2014 and to Chinese Utility Model Filing No. 201420057281.X, filed Jan. 29, 2014, the entire contents of all of which are hereby incorporated by reference herein.

BACKGROUND

The present invention relates to an accessory tool for a vacuum cleaner.

Ceiling fan blades often accumulate dust due to their flat position. The fan's height makes it difficult for a user to clean. Additionally, dust removed from the ceiling fan blades can fall when the ceiling fan blades are being cleaned.

SUMMARY

In one embodiment, the invention provides an accessory tool for a vacuum cleaner, the accessory tool includes a main body including a suction conduit configured to be coupled to the vacuum cleaner, a suction opening in fluid communication with the suction conduit, a longitudinal first brush made from a first material positioned adjacent the suction opening, and a second brush spaced from the first brush forming a brush opening between the first and second brushes configured to receive an object being cleaned. The second brush is made from a second material different than the first material and generally positioned over the first brush.

In another embodiment, the invention provides an accessory tool for a vacuum cleaner that includes a main body having a suction conduit configured to be coupled to the vacuum cleaner. The main body further includes a suction opening in fluid communication with the suction conduit, a longitudinal brush positioned adjacent the suction opening. The brush having a longitudinal first side and a longitudinal second side and a portion of the suction opening extends along both the first and second longitudinal sides of the brush.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
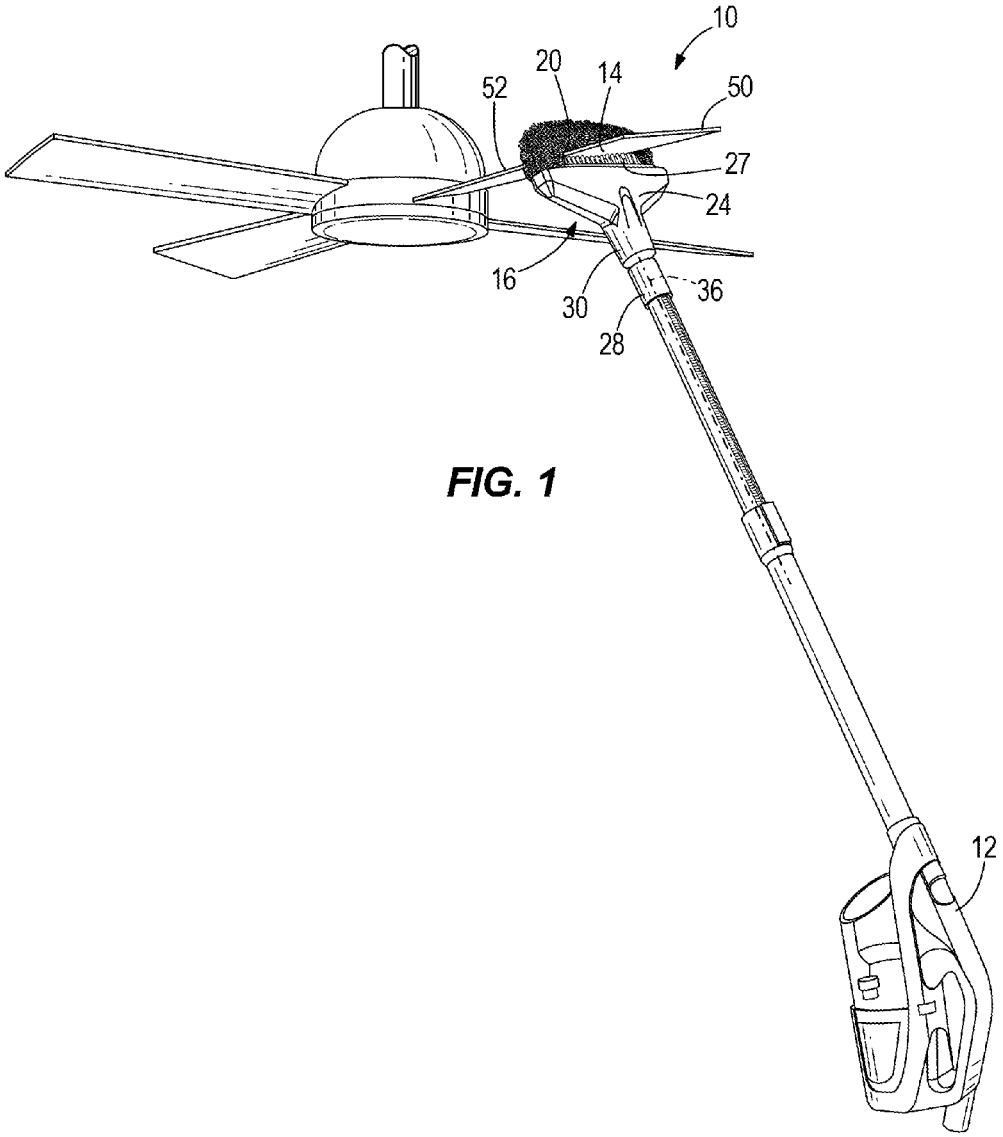
FIG. 1 is a perspective view of an accessory tool according to one embodiment.

FIG. 1 illustrates an accessory tool 10 for a vacuum cleaner 12 that is operable to clean an object 14, for example a ceiling fan blade. The accessory tool 10 includes a main body 16, a generally longitudinal first brush 27, a second brush 20 spaced from the first brush forming a brush opening 22 between the first and second brushes.

Figure 2:
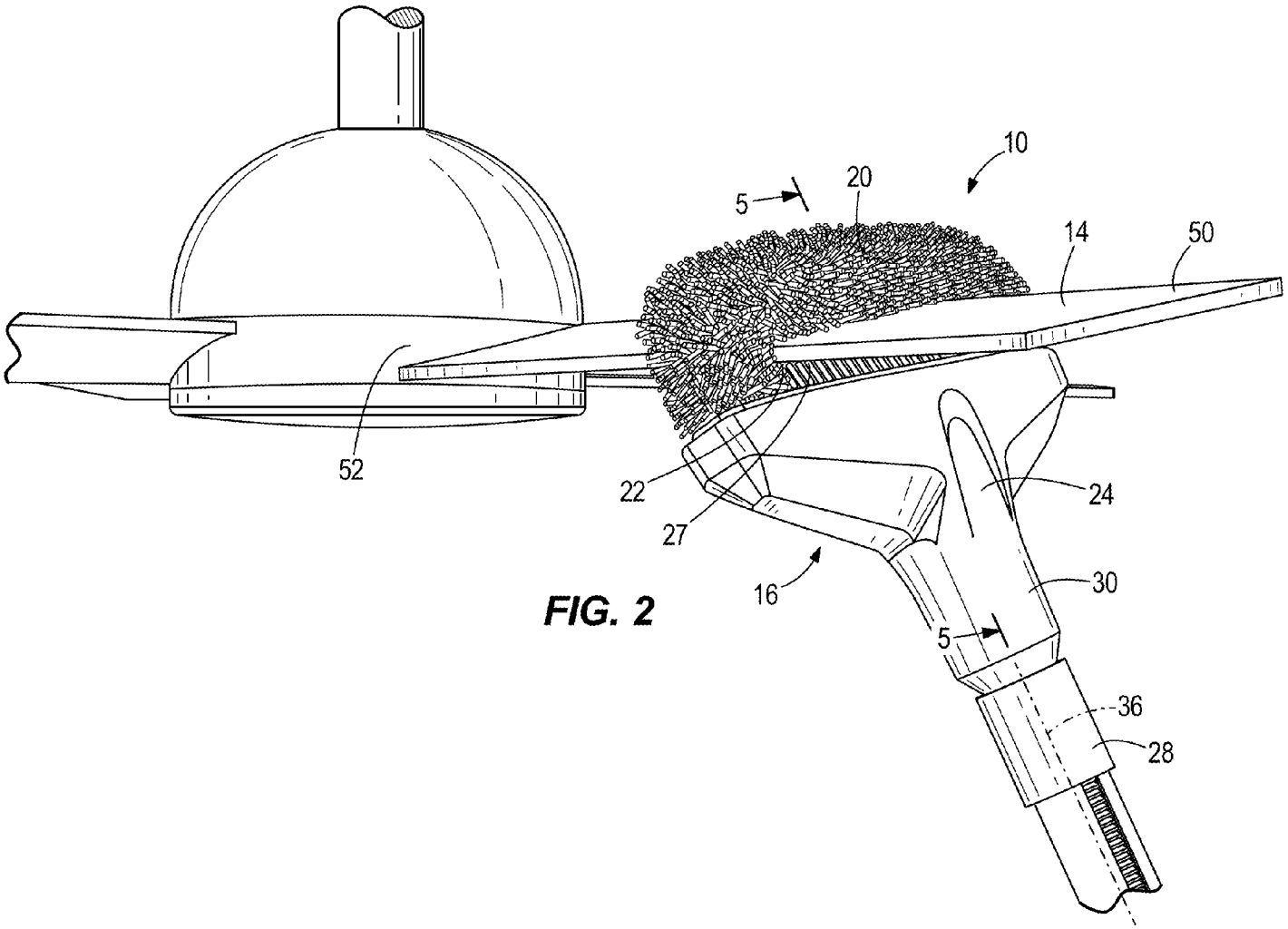
FIG. 2 is an alternative perspective view of the accessory tool of FIG. 1.
Figure 3:
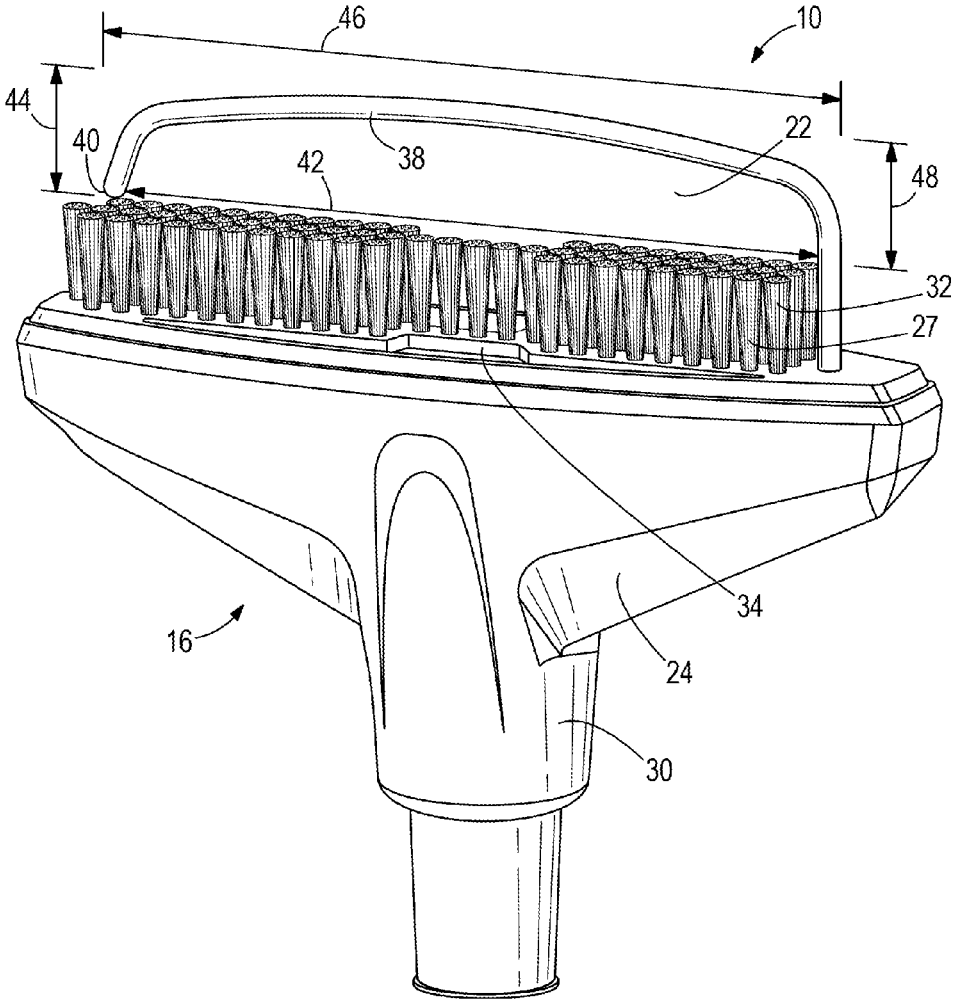
FIG. 3 is a perspective view of the accessory tool of FIG. 1 with a second brush removed.
Figure 4:
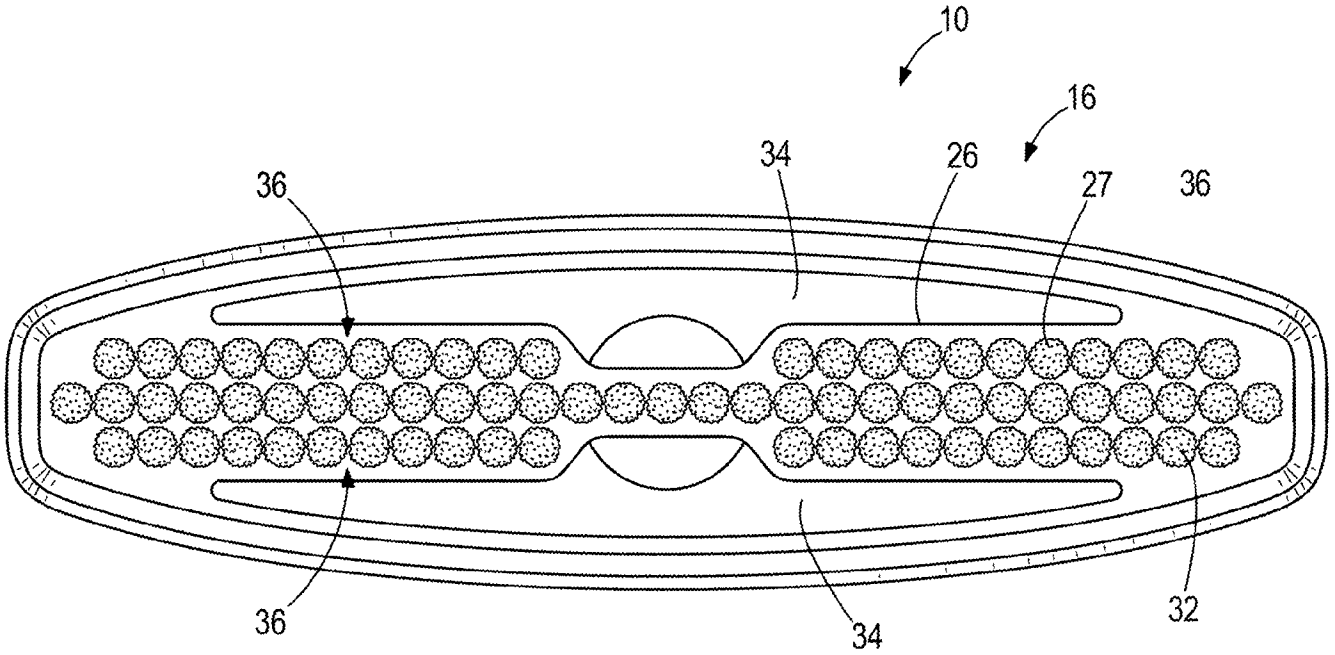
FIG. 4 is a top view of the accessory tool of FIG. 1 with the second brush and a support member removed.
Figure 5:
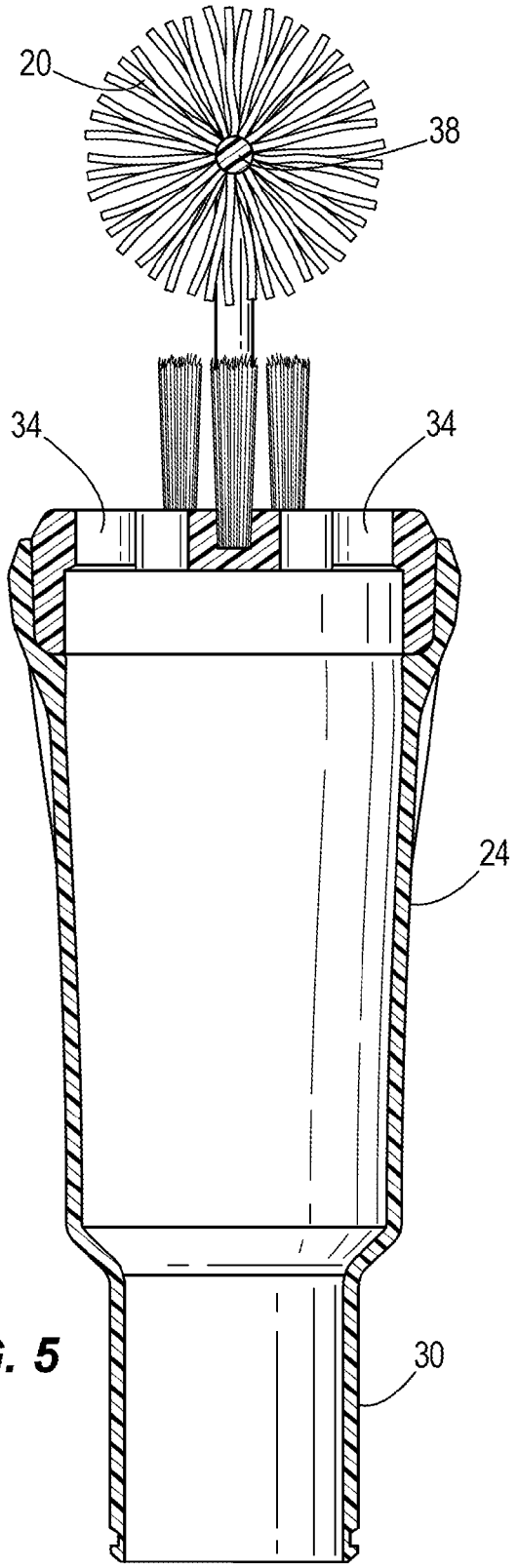
FIG. 5 is a cross-sectional view of the accessory tool of FIG. 1.

Referring to FIGS. 2 and 4, the main body 16 includes a suction conduit 24, a suction opening 26, the brush 27, and a pivotable connection member 28. The suction conduit 24 is configured to be coupled to the vacuum cleaner 12 and includes a cylindrical extension 30 positioned centrally relative to the main body 16. The main body 16 includes the suction opening 26 in fluid communication with the suction conduit 24. Referring to FIG. 3, the main body 16 further includes the brush 27 positioned adjacent the suction opening 26, and may be positioned at least partially within the suction opening of the main body. The brush 27 is made of a first material. In the illustrated embodiment, the first material is a plurality of bristles 32, such as bristles made from one or more of animal hair, plant fibers, or polymer fibers such as nylon, polypropylene, or other polymer. In other embodiments, the first material of the brush may include other materials that can brush, wipe or sweep debris from a surface, such as foam, microfiber, fabric, feathers, cloth pads, and the like. In the illustrated embodiment, the brush 27 is placed above the suction opening 26. In another embodiment, the brush 27 may be placed partially above the suction opening 26 and partially within the suction opening 26. In a third embodiment, the brush 27 may be placed within the suction opening 26. Referring to FIGS. 3-5, the brush 27 may be positioned such that the suction opening 26 is divided forming gaps 34 or portions of the suction opening 26 on each longitudinal side 35 of the first brush 27. As shown in FIG. 5, the portions of the suction opening 26 or gaps 34 are approximately aligned with edge portions of the second brush 20. Referring to FIG. 2, the main body 16 further includes a pivotally movable connection member 28. The pivotally movable connection member 28 defines an axis 36 and allows the main body 16 to pivot about the axis 36.

Referring to FIG. 2, the brush 20, which is the second brush, is positioned above the first brush 27 and above the suction opening 26. The first brush 27 is oriented so that the first brush 27 faces toward the second brush 20. The second brush 20 is supported by a support member 38 that extends at least partially over the first brush. In the illustrated embodiment, the support member 38 curves over the first brush 27. In other embodiments, the support member 38 may partially curve over the first brush 27. In yet another embodiment, the support member may have a shape approximately matching the shape of the first brush. In the illustrated embodiment, the second brush 20 is made from a second material different than the first material. In the illustrated embodiment, the second brush 20 is microfiber. Alternatively or additionally, the second material of the brush may include other materials that can brush, wipe or sweep debris from a surface, such as bristles, foam, fabric, feathers, cloth pads, and the like. In the illustrated embodiment, the first brush 27 and the second brush 20 are generally fixed to the main body 16. In other embodiments, the first brush 27 and the second brush 20 may be removably coupled to the main body 16.

The brush opening 22 is defined between the first brush 27 and the second brush 20 and positioned above the suction opening 26. The brush opening 22 is surrounded by the first brush 27 and the second brush 20. The brush opening 22, the first brush 27, and the second brush 20 are all substantially perpendicular to the suction conduit 24. The brush opening 22 has a rectangular shape and is configured to receive the object 14. The brush opening 22 includes a first side 42, a second side 44, a third side 46, and a fourth side 48. The first brush 27 and the suction opening 26 extend along the first side 42. In the illustrated embodiment, the first brush 27 extends along the first side 42 and the second brush 20 is located along the second side 44, the third side 46, and the fourth side 48. In another embodiment, the first brush 27 is located along the first side 42, the second side 44, and the fourth side 48, and the second brush is located along the third side 46. In a third embodiment, the first brush 27 is located along the first side 42 and the second side 44, and the second brush 20 is located along the third side 46 and the fourth side 48. In the embodiment illustrated in FIG. 3, the support member 38 is coupled to the main body 16 adjacent the fourth side 48, and the support member provides a gap 40 between the main body 16 and the support member 30 adjacent the second side 44. The gap 40 between the main body 16 and the support member 30 may be sized for passing a fan blade between through the gap 40 into the gap 22 between the first and second brushes 27, 20. Alternatively, the gap 40 between an end of the support member 30 and the main body 16 may be minimized to prevent a fan blade from passing through the gap 40. In yet another alternative, the support member 30 may be attached to the main body 16 on both ends omitting the gap 40. The gap 40 between an end of the support member 30 and the main body 16 may be provided to install the second brush 20 onto the support member 38.

In operation, the user attaches the accessory tool 10 to the vacuum cleaner 12. The user then positions the accessory tool 10 such that a proximal end 50 of the object 14 being cleaned, such as a fan blade, is positioned inside the brush opening 22. The user pushes the accessory tool 10 along the object 14 until a distal end 52 of the object 14 is reached. As the accessory tool 10 travels along the object 14, the first brush 27 dislodges dust and debris from the bottom of the object 14. The dirt and debris travel into the main body 16 of the accessory tool 10 through the gaps 34 of the first brush 27 that are in fluid communication with the suction opening 26. Additionally, the second brush 20 collects dust and debris from the top and sides of the object 14. When the user reaches the distal end 52 of the object 14, the user reverses direction, sliding the accessory tool 10 off of the proximal end 50 of the object 14. With the object 14 removed, the dust and debris collected on the second brush 20 travel into the main body 16 of the accessory tool 10 through the gaps 34 in the first brush 27 that are in fluid communication with the suction opening 26. The dust and debris then travel into the body of the vacuum cleaner 12.

Various features and advantages of the invention are set forth in the following claims.

What is claimed is:

1. An accessory tool for a vacuum cleaner, the accessory tool comprising:

a main body including, a suction conduit configured to be coupled to the vacuum cleaner, a suction opening in fluid communication with the suction conduit, a longitudinal first brush made from a first material positioned adjacent the suction opening, and a second brush spaced from the first brush forming a brush opening between the first and second brushes configured to receive an object being cleaned, wherein the second brush is made from a second material different than the first material and generally positioned over the first brush.

2. The accessory tool of claim 1, wherein the brush opening is approximately rectangular.

3. The accessory tool of claim 1, wherein the second brush includes microfiber and the first brush includes a plurality of bristles.

4. The accessory tool of claim 1, wherein the second brush includes microfiber and the first brush includes a pad.

5. The accessory tool of claim 1, wherein the second brush is supported by a support member and the support member extends at least partially over the first brush.

6. The accessory tool of claim 1, wherein the brush opening is surrounded by the first brush and the second brush.

7. The accessory tool of claim 1, wherein at least a portion of the first brush is oriented toward at least a portion of the second brush.

8. The accessory tool of claim 1, wherein at least a portion of the suction opening extends along at least one longitudinal side of the first brush.

9. The accessory tool of claim 8, wherein said at least a portion of the suction opening is aligned with an edge portion of the second brush.

10. The accessory tool of claim 1, wherein at least a portion of the suction opening extends along both longitudinal sides of the first brush.

11. The accessory tool of claim 10, wherein each of said at least a portion of the suction openings are aligned with opposing edge portions of the second brush.

12. The accessory tool of claim 1, wherein the first brush includes a plurality of bristles with gaps between the plurality of bristles in fluid communication with the suction opening.

13. The accessory tool of claim 1, wherein the first brush is at least partially positioned above the suction opening of the main body.

14. The accessory tool of claim 1, wherein the first brush, the second brush, and the brush opening are substantially perpendicular to the suction conduit.

15. The accessory tool of claim 1, wherein the brush opening includes a first side, a second side, a third side, and a fourth side, wherein the first brush is located along the first side and the second brush is located along at least a portion of each of the second, third, and fourth sides.

16. The accessory tool of claim 15, wherein the suction opening extends along the first side.

* * * * *